United States Patent [19]

Pichette

[11] 4,156,992

[45] Jun. 5, 1979

[54] FEED CONTROL ADAPTER

[76] Inventor: Joseph L. Pichette, 24 Spruce St., Bloomfield, Conn. 06002

[21] Appl. No.: 849,030

[22] Filed: Nov. 7, 1977

[51] Int. Cl.[2] ..... B24B 11/02

[52] U.S. Cl. ..... 51/215 R; 222/545; 241/186.2

[58] Field of Search ..... 51/130, 215 R, 289 S; 222/199, 200, 545, 559, 561, 564; 241/171, 186 R, 186.2, 186.3, 224, 225, 226

[56] References Cited

U.S. PATENT DOCUMENTS

| | | | |
|---|---|---|---|
| 1,014,383 | 1/1912 | Frazee | 241/224 |
| 1,772,365 | 8/1930 | Pratt | 51/130 |
| 2,434,707 | 1/1948 | Marshall | 241/225 X |
| 2,907,498 | 10/1959 | van der Lely et al. | 222/199 |
| 3,250,042 | 5/1966 | Messerschmidt | 51/130 |
| 3,815,527 | 6/1974 | Dobbins | 222/561 |

*Primary Examiner*—Nicholas P. Godici
*Assistant Examiner*—Robert P. Olszewski

[57] ABSTRACT

A feed control adapter operable for effecting the regulation of the flow of ball bearings to a ball grinding machine. The adapter is intended to be installed upstream of a ball grinding machine and includes first and second flow regulating devices and an automatic ball flow shut-off. The first and second ball flow regulators may be actuated either independently of each other or in concert. The automatic ball flow shut-off becomes operative when an excess number of balls are delivered to the entrance of the grinder feed chute as a result of the action of the balls themselves which function as a valve to stop the feed of the balls.

10 Claims, 4 Drawing Figures

FEED CONTROL ADAPTER

BACKGROUND OF THE INVENTION:

(1) Field of the Invention

The present invention relates to feed control devices, and more particularly to an improvement in feed control devices of the type which are designed to effect the regulation of the flow of balls to a ball grinding machine. More specifically, this invention consists of a technique for controlling a fluidic ball feed mechanism to prevent spillage of balls at the entrance to a ball grinding station. Accordingly, the general objects of the invention are to provide novel and improved apparatus and methods of such character.

(2) Description of the Prior Art

It has long been a common practice in the prior art to perform a machining operation on ball bearings for purposes of reducing them to the desired size and sphericity. Moreover, the particular machining operation which is most often utilized in this connection involves some form of grinding operation. To this end, the balls are made to pass through a ball grinding machine. However, in actual practice, in order to ensure that the balls are ground properly, it has been found most desirable to effect the necessary grinding of the balls by causing them to make a number of passes through the ball grinding machine. During each of theses successive passes, the balls are further reduced until finally, when the balls leave the ball grinding machine for the last time, they each embody the size and sphericity desired of them.

The original models of ball grinding machines embodied a mode of operation which commonly was characterized as being in the nature of a discontinuous form of operation. Namely, in accordance therewith, a predetermined quantity of balls had to be manually loaded into the ball grinding machine, whereupon the balls were ground. Once the balls had been ground to the desired extent, the balls then had to be manually removed from the ball grinding machine. Thereafter, a new group of balls would be loaded into the ball grinding machine, followed by the steps of grinding and removing the balls from the ball grinding machine. This necessity of having to repeatedly load and unload balls in groups adversely affected the production rate at which balls could be ground in the early models of ball grinding machines, and thus represented a serious disadvantage which such machines possessed.

One of the first improvements which was sought to be made in the early models of ball grinding machines involved the attempt to provide the latter with means operable to permit the balls to be fed continuously to the grinding machine. Many continuous feed approaches have been pursued. One early version of a continuous ball feed system is to be found described and illustrated in U.S. Pat. No. 1,772,365 to Pratt. With the advent of continuous ball feeding systems, not only was there achieved an increase in the production rate at which balls could be ground, but the need for each ball grinding machine to be manned by a separate operator was eliminated. Rather, the use of a continuous ball feeding system made it feasible for one employee to monitor the operation of a plurality of ball grinding machines, thereby concomitantly effecting a reduction in the cost of labor required to perform the desired machining of balls through the use of ball grinding machines.

However, with the coming of ball grinding machines equipped with continuous ball feeding systems, it soon became apparent that there existed a need to be able to regulate the rate at which balls were being fed to the ball grinding machines. To this end, a variety of schemes were devised whereby the flow of balls to a ball grinding machine could be regulated so as to compensate for the existence of variations in such characteristics as the nature, size, weight, etc. which might prevail between the different types of balls which were to undergo grinding in a ball grinding machine. Commonly, the methods employed to effect such regulation of the feeding of balls to a ball grinding machine involved the making of adjustments to the ball grinding machine and/or the ball feeding system prior to the commencement of the grinding operation. Once the grinding operation had been commenced, very little further regulation of the flow of balls to the ball grinding machine could be accomplished.

In recent years, a number of additional refinements have been made to the construction as well as the mode of operation of ball grinding machines. One such refinement involved the equipping of ball grinding machines with means operable to effect the automatic regulation of the ball feed while the ball grinding machine was running. Such automatic regulators often had the capability of completely shutting down the operation of the conveyor system, by means of which balls were fed to the ball grinding machine, in the event that some predetermined operating condition was indicated as being present. One form of automatic shut-off which has been employed comprises a feeler arm connected in an electrical detection circuit whereby, when abnormal ball feeding conditions are sensed to exist, appropriate corrective action can be initiated in response to a signal being generated by the feeler arm. Such a system is to be fond described and illustrated in U.S. Pat. No. 3,250,042 to Messerschmidt.

Notwithstanding the many improvements which have been made to date to ball grinding machines and the ball feeding mechanisms commonly found associated therewith, there has nevertheless been found that a need has existed to provide a ball feed control system which would be less complex in construction and less costly to provide than the mechanisms currently available, but yet one which would still be capable of providing the desired degree of dependable operation.

SUMMARY OF THE INVENTION:

In accordance with a preferred form of the invention there is provided a novel and improved feed control adapter which is operable for effecting the regulation of the flow of ball bearings to a ball grinding machine while the machine is running. The feed control adapter is designed to be installed upstream of the ball grinding machine; namely, between the feed board and the grinder feed chute through which the ball bearings pass as they are fed to the ball grinding machine. The feed control adapter includes chamber means, first ball flow regulating means, second ball flow regulating means and automatic ball flow shutoff means. The chamber means comprises a pair of cooperating chambers through which the balls are made to pass in the course of being fed to the ball grinding machine. The first ball flow regulating means, which is operative to effect a first measure of regulation of the feed of balls to the ball grinding machine, is located in juxtaposed relation to a first one of the pair of cooperating chambers, and comprises a first sliding door movable in a generally horizontal plane to effect the opening or closing of an exit opening provided in said first one of the pair of cooperating chambers through which the balls are designed to be made to pass. The second ball flow regulating means, which is operative to effect a second measure of regulation of the feed of balls to the ball grinding machine, is located in juxaposed relation to the second one of the pair of cooperating chambers, and comprises a second sliding door movable in a generally vertical plane to effect the opening or closing of an entrance opening provided in said second one of the pair of cooperating chambers, through which the balls are designed to be made to pass. The automatic ball shut-off means, which is operative to effect the shut-off of the flow of balls to the ball grinding machine when an excess number of balls are delivered to the entrance of the ball grinding machine, comprises a vertical chamber formed between the pair of cooperating chambers of said chamber means into which the balls back-up thereby acting in the manner of a valve to stop the feed of the balls.

It is therefore an object of the present invention to provide a novel and improved feed control adapter operable for effecting the regulation of the flow of balls to a ball grinding machine while the machine is running.

It is another object of the present invention to provide such a feed control adapter which is operative to prevent the spillage of balls awaiting grinding at a ball grinding machine.

It is still another object of the present invention to provide such a feed control adapter which is designed to be installed upstream of a ball grinding machine.

A further object of the present invention is to provide such a feed control adapter which includes first ball flow regulating means operable for effecting a first measure of regulation of the feed of balls to a ball grinding machine.

A still further object of the present invention is to provide such a feed control adapter which includes second ball flow regulating means operable for effecting a second measure of regulation of the feed of balls to a ball grinding machine.

Yet another object of the present invention is to provide such a feed control adapter wherein the first ball flow regulating means and the second ball flow regulating means are operable either independently of each other or in concert.

Yet still another object of the present invention is to provide such a feed control adapter which further includes an automatic ball flow shut-off means, which becomes operative when an excess number of balls are delivered to the entrance of the ball grinding machine, to effect a complete cessation of the feed of balls to a ball grinding machine.

Figure 1:
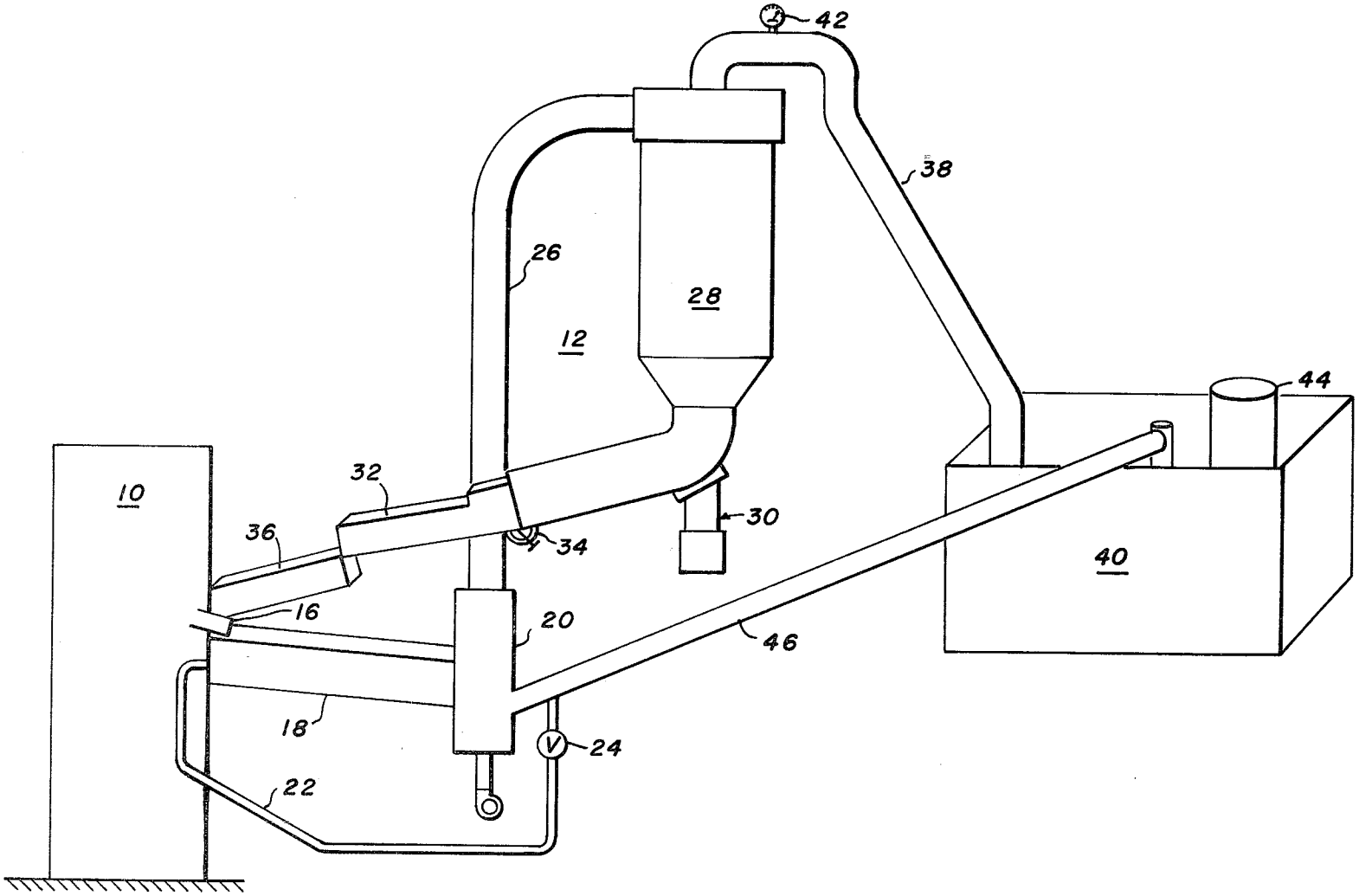
FIG. 1 PRIOR ART
FIG. 1 is a block diagram of a ball grinding machine with associated ball conveying means embodying a feed control adapter constructed in accordance with the present invention.

DESCRIPTION OF THE PREFERRED EMBODIMENT:

Referring now to FIG. 1 of the drawing, there is illustrated therein a block diagram form a ball grinding machine, generally designated by reference numberal 10. The ball grinding machine 10 has associated therewith a venturi ball conveyor system 12 of a type embodying a construction which is well-known in the prior art and which, accordingly, will only be briefly described herein. More particularly, inasmuch as the details of construction of the ball grinding machine 10 and its associated venturi ball conveyor system 12 are only indirectly related to the feed control adapter 14, which forms the subject matter of the present invention, it has not been deemed necessary to include herein a detailed description thereof. Such a detailed description of the type of ball grinding machine with associated venturi ball conveyor system which is intended to be represented by the illustration contained in FIG. 1 of the drawing can be found set forth by way of exemplification in U.S. Pat. No. 2,764,851 to Dieterichs.

Referring again to FIG. 1 of the drawing, as depicted therein once the balls have been passed through the ball grinding machine 10, they exit from the latter by means of a chute 16. From the chute 16, the balls enter the venturi ball conveyor system 12. More specifically, from the grinder discharge chute 16 the balls are delivered the open topped entrance chute 18 of the ball conveyor system 12. Upon existing from the entrance chute 18, the balls are made to pass through a pump mechanism 20 wherein a venturi action is established, which effects the further movement of the balls through the ball conveyor system 12. Inasmuch as the details of construction of devices such as the pump mechanism 20 are well-known to those skilled in the art, it is not deemed necessary to provide a description thereof herein. Rather, it is deemed sufficient to merely state that the pump mechanism 20 may take the form, for instance, of the device referred to as a jet pump in the aforementioned U.S. Pat. No. 2,764,851 to Dieterichs.

Insofar as concerns the passage of the balls through the chute 16 of the ball grinding machine 10, this is preferably accomplished under the influence of gravity. To this end, chute 16 is preferably inclined downwardly from the entrance end to the exit end thereof. The chute 18 of the ball conveyor system 12 is similarly inclined downwardly from the entrance end to the exit end thereof. Consequently, some of the movement of the balls in the chute 18 is attributable to the influence of gravity acting thereon. However, a liquid, preferably water, is also fed to the entrance end of the chute 18 and therethrough. Accordingly, the effect of this water feed is to cause the balls to be carried through the chute 18 therewith to the entrance end of the pump mechanism 20. The water feed to the chute 18 is accomplished by means of a tube 22, which preferably has a water pressure reducing valve 24 provided intermediate the ends thereof. As shown in FIG. 1, the tube 22 has one end thereof connected to the entrance end of the chute 18, while the other end of the tube 22 is connected in a manner yet to be described.

From the pump mechanism 20, the balls are fed, as a result of the water feed and the venturi action, into and through the ball conveyor tube 26, to the entrance end the ball hopper 28. Completing the description of the feed path of the balls to and from the ball grinding machine 10, after being deposited into the top of the ball hopper 28 the balls drop through the latter and exit from the bottom thereof. Suitable control means, generally designated in FIG. 1 by reference numeral 30, is preferably cooperatively associated with the ball hopper 28. The control means 30, which can be of any suitable conventional construction, is intended to function to control the rate at which balls are allowed to leave the ball hopper 28 and travel onward to the ball grinding machine 10. Upon leaving the ball hopper 28, the balls are deposited on to a feed board 32. Suitable means 34 is preferably provided adjacent the entrance end of the feed board 32 and is operative to permit adjustments to be made in the pitch; i.e., the angle of inclination; of the feed board 32 if found necessary to achieve the proper rate of feed of balls along the feed board 32. From the feed board 32, the balls are fed to a grinder feed chute 36, and therethrough into the ball grinding machine 10 itself. Thus, it will be understood from the above description that there has been established a closed feed path whereby balls leaving chute 16 of the ball grinding machine 10 are fed along to and through a ball hopper 28, and eventually once again enter the ball grinding machine 10 by means of the grinder feed chute 36.

As regards the path of flow of the water, the top of the ball hopper 28 has connected thereto one end of a water return hose 38. The other end of the hose 38 is connected to a water supply tank 40. Preferably, as depicted in FIG. 1 of the drawing, a water pressure gauge 42 is inserted along the water return hose 38 so as to be located in relatively close proximity to the top of the ball hopper 28. A pump 44 is associated with the water supply tank 40 and is operative to pump water from the supply tank 40 into and through a water pressure line 46. The water pressure line 46, as shown in FIG. 1, has one end thereof connected to the water supply tank 40 and the other end thereof connected to the pump mechanism 20. In addition, the other end of the previously described tube 22 is also connected in fluid flow relation with the water pressure line 46. Moreover, the previously described water pressure reducing valve 24 is designed to be operative to regulate the pressure of the water flowing in the tube 22 and thereby also in the line 46.

Figure 3:
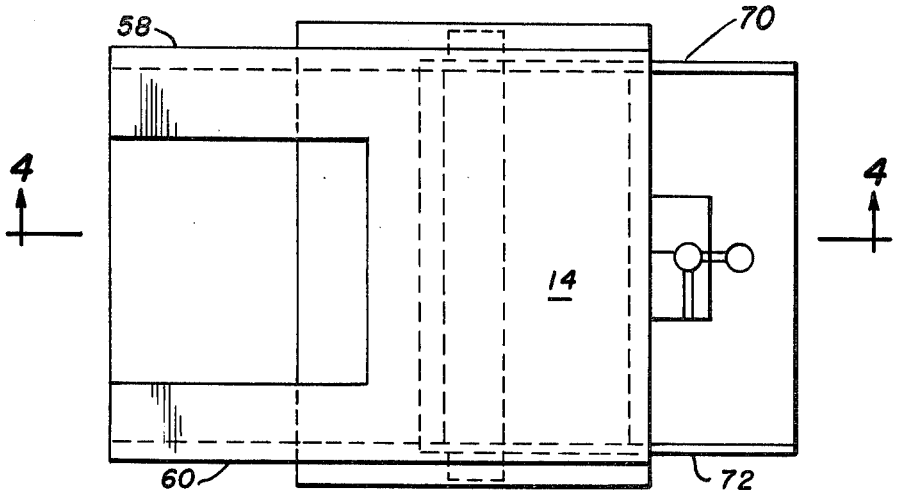
FIG. 3 is a top plan view of the feed control adapter of FIG. 2.
Figure 2:
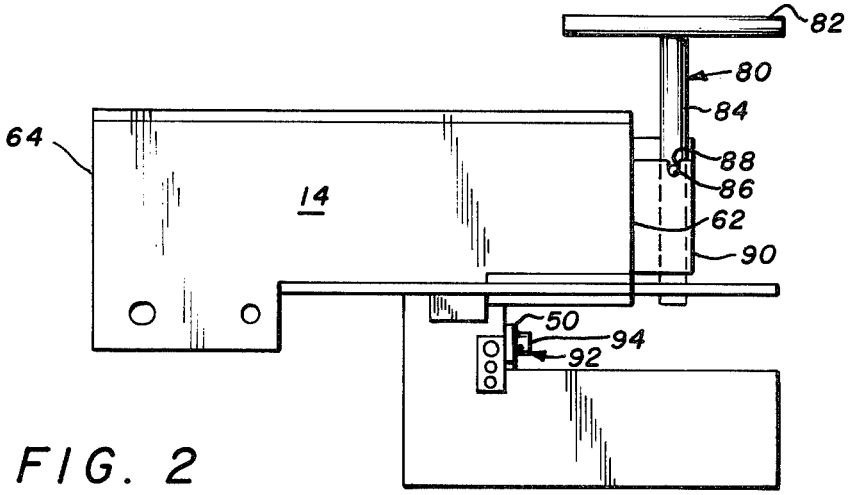
FIG. 2 is a side elevational view of a feed control adapter constructed in accordance with a preferred embodiment of the present invention.
Figure 4:
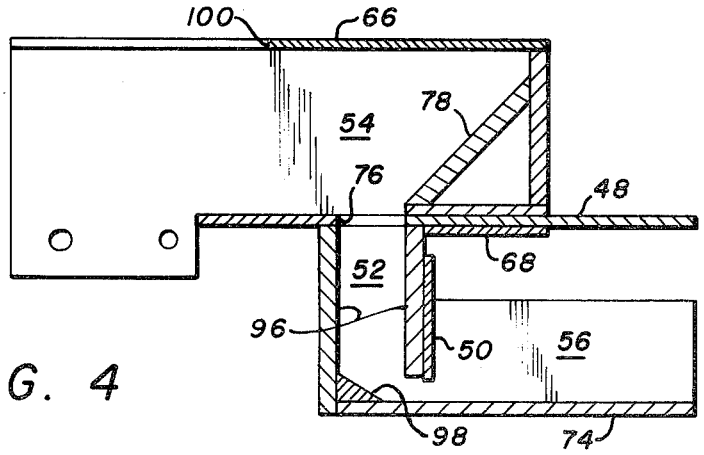
FIG. 4 is a partial sectional view of the feed control adapter of FIG. 3 taken substantially along the line 4—4 of FIG. 3.

Turning now to a consideration of FIGS. 2, 3 and 4 of the drawing, there will be set forth a description of the feed control adapter 14 of the present invention. The feed control adapter 14 is designed to be installed, for example, in the ball conveyor system 12 of FIG. 1 in a manner whereby the feed control adapter 14 is interposed in interconnecting relation between the exit portion of the feed board 32 and the entrance portion of the grinder feed chute 36. The feed control adapter 14, as will become more readily apparent from the description thereof which follows, is suitably configured so as to effect a smooth structural transition between the exit portion of the feed board 32 and the entrance portion of the grinder feed chute 36.

Proceeding now to a description of the feed control adapter 14, the latter, as will be best understood with reference to FIG. 4 of the drawing, includes chamber means, a first ball flow regulating means 48, a second ball flow regulating means 50, and an automatic ball flow shut-off means 52. The chamber means of the feed control adapter 14 consists of a pair of cooperating chambers 54 and 56. As will be understood with reference to FIGS. 2, 3 and 4 of the drawing, the chambers 54 and 56 are each substantially rectangular in configuration. More specifically, the chamber 54 is defined by a pair of side walls 58 and 60, a pair of end walls 62 and 64, a top wall 66 and a bottom wall 68, all joined together by any suitable means such as through the use of fasteners, not shown, to form a box-like structure. Similarly, the chamber 56 includes a pair of side walls 70 and 72, and a bottom wall 74. As will be described more fully subsequently, the top of the chamber 56 is preferably left open, and one end wall of the chamber 56 is also open, while the other end wall of the chamber 56 is preferably formed by a portion of the automatic ball shut-off means 52.

Turning now to a consideration of the first ball flow regulating means 48 and the second ball flow regulating means 50, reference will again be had for this purpose of FIG. 4 of the drawing. The first ball flow regulating means 48 comprises a first sliding door which is movable in a generally horizontal plane. As depicted in FIG. 4, the sliding door 48 is suitably supported through the use of any appropriate supporting means, not shown, in juxtaposed relation to the bottom wall 68 of the chamber 54. The sliding door 48 may be considered as functioning as a portion of the bottom surface of the chamber 54. The sliding door 48 has an opening 76 formed therein through which the balls, which are fed to the feed control adapter 14, are designed to pass. The opening 76, which is suitably dimensioned so as to permit balls of differing diameters to pass therethrough, is suitably located in the sliding door 48 so as to be capable of registering with one end of the automatic ball shut-off means 52, whereby to allow balls to feed from the chamber 54 into the automatic ball shut-off means 52. On the other hand, by moving the sliding door 48 relative to the bottom wall 68 of the chamber 54, the opening 76 formed in the sliding door 48 can be positioned such that the opening 76 no longer is in communication with the entrance of the automatic ball shut-off means 52, whereby the balls in chamber 54 are prevented from feeding from the latter into the former. Also, instead of completely preventing the feed of balls from the chamber 54 into the automatic shut-off means 52, the sliding door 48 may be moved in such a manner that only a portion of the opening 76 formed in the sliding door 48, which portion is still sufficiently large to permit a ball to pass therethrough, is in communication with the entrance of the automatic ball flow shut-off means 52, thereby having the effect of simply restricting the rate at which balls are fed from the chamber 54 to the automatic ball flow shut-off means 52. It can thus be seen that simply by adjusting the position of the opening 76 provided in the sliding door 48 relative to the entrance of the automatic ball flow shut-off means 52, the flow of balls from the chamber 54 into the automatic ball flow shut-off means 52 can be regulated even to the extent of shutting off the entire feed of balls from the chamber 54 to the automatic ball flow shut-off means 52, in the event that this should be deemed desirable. Moreover, this regulation of the rate of feed of the balls can be effected while the ball grinding machine 10 is running.

It should be noted that, as shown in FIG. 4, the chamber 54 may be provided with a sloping surface formed by a member 78 which is suitably supported within the chamber 54 through the use of any appropriate conventional supporting means, not shown, so as to be located in juxtaposed relation to the entrance of the automatic ball flow shut-off means 52; namely, with one end of the member 78 being secured adjacent to the entrance of the automatic ball flow shut-off means 52 and with the other end of the member 78 being secured to the rear wall of the chamber 54. The function of the sloping surface 78 is to assist in guiding the balls as they are fed from the chamber 54 to the automatic ball flow shut-off means 52. Obviously, if so desired, the sloping surface 78 may be omitted, or another suitable means substituted therefor, without departing from the essence of the invention.

For purposes of effecting the sliding movement of the door 48, a suitable operating means cooperatively associated with door 48 is provided. By way of example, such operating means for the sliding door 48 may take the form of the manually operable means, generally designated by the reference numeral 80, which is depicted in FIG. 2 of the drawing. The manually operable means 80, as illustrated in FIG. 2, includes a handle 82 and a rod-like member 84, the latter being suitably joined to the handle 82 so as to be movable therewith as a single unit. The free end of the member 84 is engageable with the sliding door 48 whereby, by the manipulation of the handle-like member 82, movement can be imparted therethrough to the sliding door 48, i.e., the latter can be made to slide back and forth in a substantially horizontal plane. As shown in FIG. 2, the rod-like member 84 is preferably provided with an outwardly extending peg 86 which projects from the rod-like member 84 at substantially right angles thereto. The peg 86 is suitably dimensioned so as to be receivable in a slot 88 formed for this purpose in a member 90 which is affixed to the outer surface of the rear wall 62 of the chamber 54. The peg 86 and the slot 88 function as positioning means whereby, with the peg 86 resting in the slot 88, the sliding door 48 is suitably located relative to the bottom surface of the chamber 54 such that the opening 76 formed in the sliding door 48 is in communication with the entrance to the automatic ball flow shut-off means 52. Although one particular form of means operable for imparting sliding motion to the sliding door 48 has been described herein and illustrated in the drawing, it is to be understood that other means, operable either manually or automatically, could also be employed without departing from the essence of the invention.

Considering now the second ball flow regulating means 50, the latter as best understood with reference to FIG. 4 of the drawing also takes the form of a sliding door. However, the sliding door 50 is suitably supported so as to be movable in a vertical plane relative to the chamber 56. More specifically, the sliding door 50 is mounted on the outer surface of one of the walls of the automatic ball flow shut-off means 52 so as to be movable relative thereto. Any suitable conventional form of mounting means, not shown, may be employed for this purpose. The sliding door 50 is designed so as to be movable towards and away from the bottom wall 74 of the chamber 56. Namely, the sliding door 50 is movable between a first position, wherein as shown in FIG. 4 of the drawing the sliding door 50 effects no blockage of the entrance to the chamber 56, and a second position wherein the sliding door 50 engages the inner surface of the bottom wall 74 of the chamber 56 thereby effecting a closure of the entrance to the chamber 56 and preventing balls from entering the chamber 56. The sliding door 50 may also be moved to positions intermediate the aforedescribed first and second positions thereof wherein the sliding door 50 is operative to restrict the rate at which balls are fed into the chamber 56 from the chamber 54.

For purposes of effecting the movement of the sliding door 50, suitable manually operable means, generally designated by reference numeral 92, is provided as shown in FIG. 2 of the drawing. The manually operable means 92 may, for example, comprise fastener means 94 receivable in suitably dimensioned openings, not shown, provided for this purpose in the aforereferenced one wall of the automatic ball flow shut-off means 52. To this end, the fastener means 94 is selectively positionable in the multiplicity of openings which are provided for this purpose in suitable spaced relation to each other whereby, depending on which of the multiplicity of openings is selected for receiving the fastener means 94, the extent to which the sliding door 50 is spaced from the bottom wall 74 of the chamber 56 will be determined. It is obviously to be understood that the fastener means 94 project through the sliding door 50 so as to be capable of entering the multiplicity of openings located in the wall of the shut-off means 52. Although a particular form of manually operable means 92 is described herein and illustrated in the drawing, it is to be understood that some other form of manually operable means could be employed in place thereof, or an automatically operable means could be substituted therefor, without departing from the essence of the present invention.

Completing the description of the feed control adapter 14, as best understood with reference to FIG. 4 of the drawing, the automatic ball flow shut-off means 52 comprises a vertical chamber which is defined by a multiplicity of joined side walls 96, and which has the entrance end thereof in communication with the chamber 54, and the exit end thereof communicating with the chamber 56. The vertical chamber 52 functions as a passage, interconnecting the chamber 54 with the chamber 56, through which balls pass during the course of their flow through the feed control adapter 14. As shown in FIG. 4, the sloping surface 98 is preferably positioned adjacent the exit end of the vertical chamber 52. Namely, the sloping surface 98 has one end thereof engaging one of the side walls 96 of the vertical chamber 52 and the other end thereof in engagement with the bottom wall 74 of the chamber 56. The function of the sloping surface 98 is to assist in guiding balls from the vertical chamber 52 into the chamber 56. It is of course to be understood that, if so desired, the sloping surface 98 could be omitted without departing from the essence of the present invention. The mode of operation of the automatic ball flow shut-off means 52 is such that the latter becomes operative when an excess number of balls are delivered to the entrance of the grinder feed chute 36. The shut-off results from the action of the balls themselves, which function as a valve to stop the feed of the balls. The valving action results from the fact that the balls back up into the vertical chamber 52 thereby stopping the flow of balls therethrough.

There will now be set forth a description of the mode of operation of the feed control adapter 14. Balls in the course of being conveyed through the venturi ball conveyor system 12 are fed to the feed board 32. Upon exiting from the feed board 32, the balls enter the chamber 54 of the feed control adapter 14 through the opening 100 provided for this purpose in the top wall 66 of the chamber 54. From the chamber 54 the balls pass through the opening 76 formed in the sliding door 48, and enter the vertical chamber 52, which is operative as an automatic ball flow shut-off means. After passing through the vertical chamber 52, the balls are fed past the sliding door 50 and enter into the chamber 56 of the feed control adapter 14. From the chamber 56 the balls enter the grinder feed chute 36 from whence the balls are fed to the ball grinding machine 10. The rate at which balls are fed from the chamber 54 to the vertical chamber 52 is capable of being regulated in response to the positioning of the sliding door 48 relative to the bottom wall 68 of the chamber 54; i.e., by varying the extent to which the opening 76 in sliding door 48 communicates with the entrance end of the vertical chamber 52. Similarly, the rate at which balls pass from the vertical chamber 52 to the chamber 56 is capable of being regulated by varying the extend to which the sliding door 50 is spaced from the bottom wall 74 of the chamber 56. Finally, as described in the preceding paragraph, the vertical chamber 52 is operative as an automatic shut-off means to shut-off the flow of balls therethrough when an excess number of balls occurs at the ball grinding machine 10.

Thus, in accordance with the present invention there has been provided a novel and improved feed control adapter operable for effecting the regulation of the flow of balls to a ball grinding machine, while the machine is running. The subject feed control adapter of the present invention is operative to prevent the spillage of balls awaiting grinding at the ball grinding machine. In accordance with the preferred form of the invention, the feed control adapter is designed to be installed upstream of the ball grinding machine. The feed control adapter of the present invention includes first ball flow regulating means operable for effecting a first measure of regulation of the feed of balls to the ball grinding machine, and second ball flow regulating means operable for effecting a second measure of regulation of the feed of balls to the ball grinding machine. Moreover, in accord with the present invention the first ball flow regulating means and the second ball flow regulating means of the feed control adapter are operable either independently of each other, or in concert. In addition, the feed control adapter of the present invention includes an automatic ball flow shut-off means, which becomes operative when an excess number of balls are delivered to the entrance of the ball grinding machine, to effect a complete cessation of the feed of balls to the ball grinding machine. Further, the feed control adapter of the instant invention is compatible for use with most of the existing versions of ball grinding machines. Finally, in accord with the instant invention a feed control adapter has been provided which is relatively simple in construction, easy to employ and relatively inexpensive to provide, but yet which is still capable of providing dependable operation.

While only one embodiment of the present invention has been shown, it will be appreciated that modifications thereof, some of which have been noted in the preceding description, may readily be made by those skilled in the art. Accordingly, it will be understood that the appended claims are intended to cover the modifications specifically referred to herein as well as all other modifications which fall within the true spirit and scope of the invention.

What is claimed is:

1. A feed control adapter, positionable in the path of movement of articles being fed to an article machining device and operable for effecting the regulation of the feed of the articles while the article machining device is running, comprising:

chamber means providing an entrance to and an exit from the feed control adapter for articles being fed to the article machining device, said chamber means defining a feed path for articles moving through the feed control adapter;

first article flow regulating means mounted in juxtaposed relation to said chamber means for sliding movement relation thereto, said first article flow regulating means being selectively movable between a multiplicity of different portions for providing a first degree of regulation of the flow of articles through the feed control adapter;

second article flow regulating means mounted in juxtaposed relation to said chamber means for sliding movement relative thereto, said second article flow regulating means being selectively movable between a multiplicity of different positions for providing a second degree of regulation of flow of articles through the feed control adapter; and automatic article flow shut-off means mounted in juxtaposed relation to said chamber means, said automatic article flow shut-off means being operative to effect the shut-off of the flow of articles to the article machining device when an excess number of articles are delivered to the article machining device.

2. A feed control adapter as defined in claim 1 wherein said chamber means comprises:

a pair of cooperating chambers through which the articles are made to serially pass in the course of being fed to the article machining device.

3. A feed control adapter as defined in claim 1 wherein said first article flow regulating means comprises:

a first sliding door movable in a generally horizontal plane, said first sliding door having an opening formed therein through which the articles are permitted to pass when said first sliding door is moved to selected ones of said multiplicity of different positions thereof.

4. A feed control adapter as defined in claim 1 wherein said second article flow regulating means comprises: a second sliding door movable in a generally vertical plane, said second sliding door permitting articles to pass thereby when said second sliding door is moved to selected ones of said multiplicity of different positions thereof.

5. A feed control adapter as defined in claim 1 wherein said automatic article flow shut-off means comprises:

a vertical chamber into which the articles back-up thereby acting in the manner of a valve to stop the feed of the articles.

6. A feed control adapter, positionable in the path of movement of articles being fed to an article machining device and operable for effecting the regulation of the feed of the articles while the article machining device is running, comprising:

chamber means comprising a pair of cooperating chambers, one of said pair of cooperating chambers having a first opening formed therein operable as an entrance to the feed control adapter for articles being fed to the article machining device and a second opening formed therein operable as an exit from said one of said pair of cooperating chambers, the other one of said pair of cooperating chambers having a first opening formed therein operable as an entrance to said other one of said pair of cooperating chambers and a second opening formed therein operable as an exit from the feed control adapter for articles being fed to the article machining device; and automatic article flow shut-off means operable for effecting the shut-off of the flow of articles to the article machining device when an excess number of articles are delivered to the article machining device, said automatic article flow shut-off means comprising a vertical chamber into which the articles backup thereby acting in the manner of a valve to stop the feed of the articles, said vertical chamber having the entrance end thereof supported in juxtaposed relation to said second opening of said one of said pair of cooperating chambers and the exit end thereof supported in juxtaposed relation to said first opening of said other one of said pair of cooperating chambers, said chamber means and said automatic article flow shut-off means defining a path of movement for articles through the feed control adapter.

7. A feed control adapter as defined in claim 6 further comprising:

first article flow regulating means mounted in juxtaposed relation to said second opening of said one of said pair of cooperating chambers, said first article flow regulating means comprising a first sliding door supported for sliding movement in a generally horizontal plane selectively between a multiplicity of different positions, after first sliding door having an opening formed therein and cooperating with said second opening of said one of said pair of cooperating chambers for permitting articles to pass therethrough when said first sliding door is selectively positioned in certain ones of said multiplicity of different positions thereof.

8. A feed control adapter as defined in claim 7 further comprising:

a second article flow regulating means mounted in juxtaposed relation to said first opening of said other one of said pair of cooperating chambers, said second article flow regulating means comprising a second sliding door supported for sliding movement in a generally vertical plane between a multiplicity of different positions, said second sliding door cooperating with said first opening of said other one of said pair of cooperating chambers to permit articles to pass thereby when said second sliding door is selectively positioned in certain ones of said multiplicity of different positions thereof.

9. A feed control adapter as defined in claim 8 further comprising:

first manually operable means cooperatively associated with said first sliding door for effecting the selective positioning of said first sliding door in said multiplicity of different positions thereof.

10. A feed control adapter as defined in claim 9 further comprising:

second manually operable means cooperatively associated with said second sliding door for effecting the selective positioning of said second sliding door in said multiplicity of different positions thereof.

* * * * *